United States Patent [19]

Palena

[11] 4,029,852

[45] June 14, 1977

[54] METAL NON-SKID COATING

[76] Inventor: Maximilian Palena, 1000 Wayne Road, Haddonfield, N.J. 08033

[22] Filed: Feb. 6, 1976

[21] Appl. No.: 655,939

Related U.S. Application Data

[60] Continuation-in-part of Ser. No. 477,729, June 10, 1974, abandoned, which is a division of Ser. No. 783,901, Dec. 16, 1968, Pat. No. 3,855,444.

[52] U.S. Cl. ..... 428/621

[51] Int. Cl.[2] ..... B32B 15/16

[58] Field of Search ..... 29/195 A, 195 M, 195 Y, 29/183.5, 191.2, 191

[56] References Cited

UNITED STATES PATENTS

| | | | |
|---|---|---|---|
| 3,017,689 | 1/1962 | Link et al. | 29/194 |
| 3,020,182 | 2/1962 | Daniels | 29/195 |
| 3,023,490 | 3/1962 | Dawson | 29/194 |
| 3,087,240 | 4/1963 | Gross | 29/528 |
| 3,091,548 | 5/1963 | Dillon | 117/70 |
| 3,112,212 | 11/1963 | Holowaty et al. | 117/22 |
| 3,150,937 | 9/1964 | Link et al. | 29/191 |
| 3,844,729 | 10/1974 | Sedlatschek et al. | 29/195 |

*Primary Examiner*—L. Dewayne Rutledge
*Assistant Examiner*—E. L. Weise
*Attorney, Agent, or Firm*—Sperry and Zoda

[57] ABSTRACT

Articles having a non-skid surface of a roughened character and substantial thickness embody a base sheet having a roughened surface with particles of grit bonded thereto by metal which has been solidified in place in contact with the grit particles and base sheet and further bonded in place by an overlaying layer of solidified metal.

14 Claims, 7 Drawing Figures

METAL NON-SKID COATING

ABSTRACT OF THE DISCLOSURE

This application is a continuation-in-part of copending application Serial No. 477,729, now abandoned; filed June 10, 1974, which is a division of application Serial No. 783,901 filed December 16, 1968, now issued as Patent Number 3,855,444.

BACKGROUND OF THE INVENTION

1. Field of the Invention

Materials having a rough slip resistant or non-skid surface are employed as floors, foot walks, stairways, ladders, scaffolding, platforms, and all areas where a person may stand or walk. Such non-skid surfaces are usually produced by bonding abrasive material or particles of grit to a metal or other backing material adapted to be bolted or secured in place to receive and resist wear.

2. Description of the Prior Art

It has been suggested heretofore that particles of grit may be bonded to a sheet of metal by subjecting the sheet to a hot dip method and projecting particles of grit against the layer of molten metal adhering to the sheet so as to be at least partially embedded therein as exemplified by the U.S. Pats. to Link, Nos. 2,964,419; 3,017,689 and 3,150,937. Other patents such as 2,003,019 and 3,112,213 suggest that grit particles be combined with a flux or metal coating and thereafter bonded to a base sheet whereas the U.S. Pat. to Todd, No. 2,994,762 describes a method in which an arc is passed between the base sheet and a roller to melt a fusible material in situ in contact with grit particles.

The products obtained in accordance with such prior art are difficult and expensive to produce and do not establish a satisfactory bond between the grit particles and the base sheet. Moreover, the size of the grit particles and the tickness of the layer of molten metal in which the particles are embedded are necessarily limited precluding the formation of a layer of non-skid material of substantial thickness and durability.

SUMMARY OF THE INVENTION

In accordance with the present invention an improved non-skid product is obtained wherein the particles of grit employed may be a sufficient size to present an effectively roughened surface and the layer of metal by which they are bonded to the base material may be of any desired thickness sufficient to completely encapsulate the particles of grit and insure effective bonding thereof to each other and to the base sheet.

DESCRIPTION OF THE PREFERRED EMBODIMENT

Figure 3:
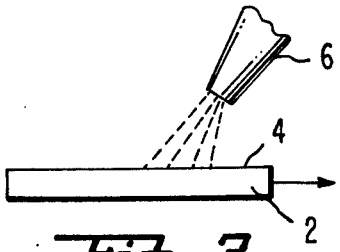
FIG. 3 is a diagrammatic illustration of equipment adapted for use in carrying out a first step employed in producing the product of FIGS. 1 and 2.

In that form of the invention chosen for purposes of illustration in the figures of the drawings, the non-skid product is provided with a base sheet or material 2 which may be formed of steel, aluminum or other metal or when the product is to be flexible, the base material may be formed of fabric, plastic or the like. The upper surface of the base material is preferably roughened by sand blasting or otherwise as indicated at 4. Thus, as illustrated in FIG. 3, the material 2 is passed beneath a sand blast nozzle 6 to roughen the upper surface thereof.

Figure 4:
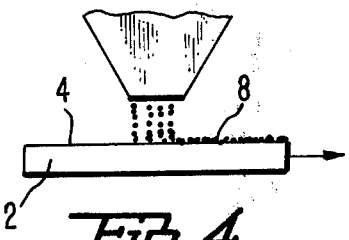
FIG. 4 illustrates a second step employed in producing the products of FIGS. 1 and 2.

Thereafter as shown in FIG. 4, a layer of grit or abrasive granules 8 is deposited on the roughened upper surface 4 of the base material so as to be in direct contact with the base and supported thereby. The particles of grit employed are preferably relatively large and of a size in the range of from about SAE 12 to SAE 50 or from about 0.028 to 0.0937 inches in diameter. Such particles may be formed of aluminum oxide, steel, glass, sand, stone, carborundum or any other hard or abrasive material and is distributed in a single layer on the upper surface of the backing material.

Figure 5:
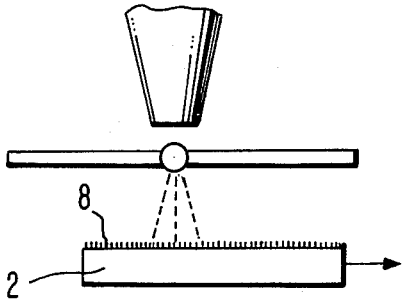
FIG. 5 illustrates a third step in the process of producing the product of FIGS. 1 and 2.

After the grit has been deposited in this way the assembly is sprayed with molten metal and as illustrated in FIG. 5, this is preferably accomplished by passing the material with the grit thereon beneath an electric arc spray mechanism. The arc serves to bring the metal to a molten state and the air or gas jet serves to atomize and direct the molten globules of metal onto and into the layer of grit on the base material.

Figure 6:
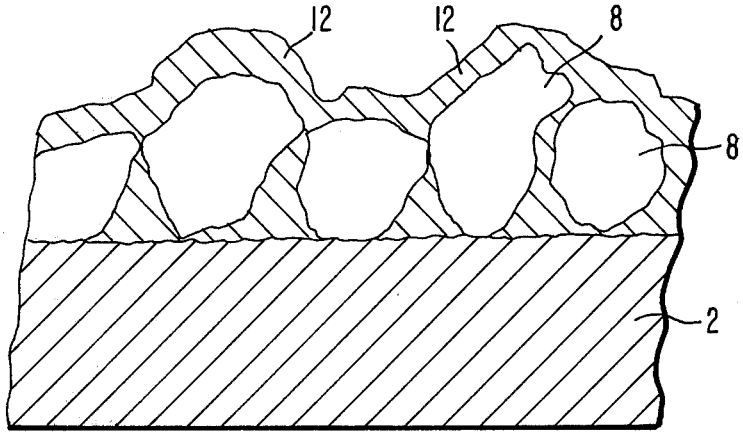
FIG. 6 is an enlarged sectional view through a sheet produced by the third step of the process as shown in FIG. 5.

The gas pressure and amperage chosen for this purpose are such that the atomized molten metal will not displace or blow the grit particles about and will bond the grit particles in place prior to the final bonding operations. The droplets of molten metal, produced by the arc and gas jet, upon contact with grit and/or base material spreads and locks the grit in place on the base material. The flow of metal locks the grit to the base material by spreading from the surface of the grit particle, to adjoining grit particles and thru spaces between the particles to the base material as shown in FIG. 6. This locking operation is of sufficient strength to allow the minimum displacement of the grit particles during the subsequent bonding operations which require much higher gas jet velocities.

Figure 1:
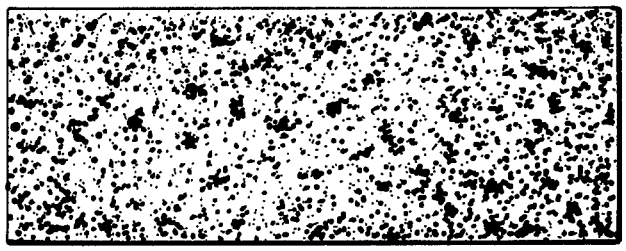
FIG. 1 is a plan view of a typical non-skid product embodying the present invention.
Figure 2:
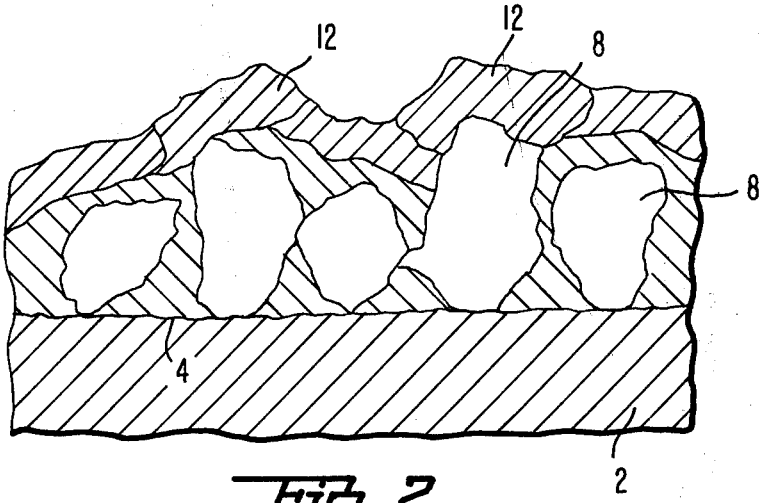
FIG. 2 is an enlarged sectional view through the product of FIG. 1.
Figure 7:
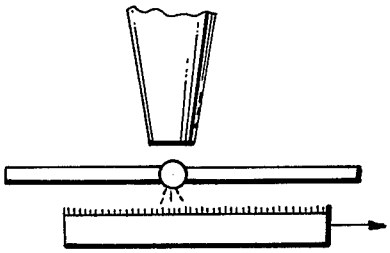
FIG. 7 illustrates a fourth step in the process whereby the product of FIG. 1 and 2 is obtained.

In order to assure more complete and permanent bonding of grit particles to the base sheet and to each other, the product of FIG. 6 is further coated with molten metal as shown in FIG. 7. For this purpose, the assembly is again passed beneath the metal arc spray mechanism. In this operation the voltage and air pressure is increased with the result that the additional hot molten metal remelts the pre-bonding layer of FIG. 6 and unites with the locking metal as it flows into contact with the grit surfaces and the roughened material surface. The resultant bond is composed of platelets 12 which spread out and bond grit to grit particles and to the roughened surface of the metal base as shown in FIG. 2. FIG. 2 shows the grit particles are substantially completely encapsulated with metal as the metal flows between the particles and into contact with the base material through the crevices formed between the lower surfaces of the particles and the roughened surface of the base material. The areas contacted by the moltened metal is thus extended to assure an effective bond between the particles and the base material and between the particles themselves. Moreover since most of the particles are in direct contact with the base material, they are positively supported by the base sheet in a manner to prevent displacement or movement thereof with respect to the base sheet. For this reason the bond between the particles and the sheet will not be weakened or ruptured when the product is subsequently subjected to heavy pressures when in use. The product is thereby given a complete cover layer of metal which serves to protect the granules from exposure on contact with a person's shoes or other wear which might displace the particles and cause them to be torn from the sheet. The wear on the product is therefore taken essentially by the metal whereas the surface of the metal partakes of the roughness of the layer of abrasive particles.

The molten metal sprayed onto the grit to bond the particles to the base sheet and to each other may be aluminum, steel and their alloys or any other metal desired and the same or a different metal may be used in forming the final exposed layer of metal in the assembly.

In the initial or locking stage as shown in FIG. 5 and 6, the following specific conditions have been found satisfactory. The arc apparatus is positioned 36 inches from the base sheet and the atomizing air is supplied at a pressure of about 10 to 25 pounds per square inch. The electricity is supplied at 30 volts and 100 amperes using aluminum wire one eighth inch in diameter. The force of air blast is insufficient to scatter the grit particles and the aluminum droplets are soft and spread out under the conditions of application. The velocity of the molten droplets is believed to be about 450 feet per second and they are believed to have a diameter of from about 0.010 to 0.025 inches.

The final or coating stage of the operation may be effected by placing the electric arc gun about 3 inches from the surface of the pre-bonded assembly using an air pressure of about 70 pounds per square inch, a voltage of 35 to 40 and amperage of 300 to 800 amps. The coating applied when using aluminum wire one eighth inch in diameter may be varied as desired.

The thickness of the final non-skid product will depend primarily upon the size of the grit particles and the thickness of the final layer of metal deposited on the upper surface thereof. For most purposes when using grit of 6 to 14 mesh size, the thickness of the final layer of metal applied thereto may be from about 0.02 to 0.08 inch or more as desired. The total thickness of the non-skid layer will therefore generally be from about 0.06 to 0.20 inch depending upon the purpose for which the product is intended.

The conditions employed in producing the non-skid product and the composition of the backing sheet, grit particles and metal employed may thus be varied considerably to produce a final product adapted for substantially any required use. It should therefore be understood that the particular embodiments of the invention described above are intended to be illustrative only.

I claim:

1. A non-skid product having a rough wearing surface comprising a sheet of backing material having a layer of grit particles in direct contact with the surface of the sheet, said particles being bonded to each other and to said sheet by solidified metal and covered by a layer of metal in direct contact with the solidified metal and serving to substantially encapsulate the grit particles, the grit particles having an average particle size exceeding 20 mesh and the thickness of the layers of grit and metal exceeding about 0.06 inch.

2. A non-skid product as defined in claim 1 wherein said grit particles have a size ranging from about 6 to 14 mesh.

3. A non-skid product as defined in claim 1 wherein the metal by which the grit particles are substantially encapsulated has a thickness of from about 0.02 to 0.08 inch.

4. A non-skid product as defined in claim 1 wherein the surface of the sheet of backing material contacted by the grit particles is roughened.

5. A non-skid product having a rough wearing surface comprising a base sheet having a roughened surface with a layer of grit particles having an average size in the range of about 6 to 14 mesh in direct contact with said surface, said grit particles being bonded to each other and to said surface by solidified metal which substantially encapsulates said grit particles and has a thickness of from about 0.03 to 0.08 inch.

6. A non-skid product as defined in claim 5 wherein said solidified metal is aluminum.

7. A non-skid product as defined in claim 5 wherein said solidified metal comprises two superimposed layers of metal.

8. A non-skid product as defined in claim 5 wherein said base sheet is formed of metal.

9. A non-skid product as defined in claim 5 wherein said base sheet is formed of steel.

10. A non-skid product as defined in claim 5 wherein said base sheet is flexible.

11. A non-skid product as defined in claim 5 wherein said base sheet is formed of fabric.

12. A non-skid product as defined in claim 5 wherein said grit particles are formed of aluminum oxide.

13. A non-skid product as defined in claim 5 wherein said grit particles are bonded to each other and said base sheet by a solidified spray of molten metal which has penetrated into the voids and crevices between the grit particles and into contact with said base sheet, and further covered by an additional layer of solidified metal sprayed onto the upper surface of said assembly.

14. A non-skid product as defined in claim 13 wherein said metal is aluminum.

* * * * *